US010300583B2

(12) United States Patent
Yang et al.

(10) Patent No.: US 10,300,583 B2
(45) Date of Patent: May 28, 2019

(54) RATCHET WRENCH

(71) Applicants: Chun-Wei Yang, Taichung (TW); Zhe-Ping Zhang, Taichung (TW)

(72) Inventors: Chun-Wei Yang, Taichung (TW); Zhe-Ping Zhang, Taichung (TW)

(73) Assignees: Chun-Wei Yang, Hang zhou (CN); Zhe-Ping Zhang, Long you (CN); ZHE JIANG YIYANG TOOL MANUFACTURE CO., LTD, Long you (CN)

( * ) Notice: Subject to any disclaimer, the term of this patent is extended or adjusted under 35 U.S.C. 154(b) by 197 days.

(21) Appl. No.: 15/424,761

(22) Filed: Feb. 3, 2017

(65) Prior Publication Data

US 2018/0222020 A1 Aug. 9, 2018

(51) Int. Cl.
*B25B 13/46* (2006.01)

(52) U.S. Cl.
CPC ..... *B25B 13/463* (2013.01)

(58) Field of Classification Search
None
See application file for complete search history.

(56) References Cited

U.S. PATENT DOCUMENTS 6,971,286 B2 * 12/2005 Hu ..... B25B 13/463 81/124.3
2005/0155463 A1 * 7/2005 Shu-Sui ..... B25B 13/463 81/63.2
2014/0366690 A1 * 12/2014 Lee ..... B25B 13/463 81/63.2
2017/0209988 A1 * 7/2017 Liu ..... B25B 13/463

* cited by examiner

*Primary Examiner* — Joseph J Hail
*Assistant Examiner* — Brian D Keller

(57) ABSTRACT

A ratchet wrench includes a body, a ratchet wheel, a pawl, a switch unit, a ring, a top clip and a bottom clip. The body includes a through hole, a first recess, a second recess, a top recessed area and a bottom recessed area to accommodate the ratchet wheel, the pawl, the switch unit, the ring, the top clip and the bottom clip. The ratchet wheel has a first pivotal portion, a top groove, a second pivotal portion and a bottom groove. The pawl has a notch. The switch unit is pivoted to control the movement of the pawl in the first recess. The ring is located in the top recessed area and has a fourth pivotal portion connected to the first pivotal portion. The top clip and the bottom clip respectively clip two ends of the ratchet wheel to restrict the ring and the ratchet wheel.

9 Claims, 7 Drawing Sheets

RATCHET WRENCH

BACKGROUND OF THE INVENTION

1. Fields of the Invention

The present invention relates to a ratchet wrench, and more particularly, to a ratchet wrench which can be easily manufactured and has better strength.

2. Descriptions of Related Art

The conventional ratchet wrench known to applicant is disclosed in U.S. Pat. No. 6,282,992, and comprises a handle; a head extended from the handle and including a hole, a web being defined between the handle and the head, a cavity being defined in the web and communicated with the hole, the web further including a compartment having a first end communicated with the cavity and a second end communicated with outside, thereby leaving a bridge in the web; a drive member rotatably mounted in the hole of the head, the drive member including a plurality of teeth formed on an outer periphery thereof; a pawl mounted in the cavity and including a first side with a plurality of ratchet teeth for releasably engaging with the teeth of the drive member; a switch member including a turn-piece for manual operation and an actuating plate extended from the turn-piece and rotatably received in the second end of the compartment of the web, the switch member being switchable between two positions for changing ratcheting direction of the drive member; an elastic element and a peg mounted in the cavity and between the pawl and the actuating plate, with the peg being received in the elastic element and in the receptacle, with the peg and the elastic element being rotatable with the actuating plate, the pawl further including a second side with a recess, the peg having a first end movably received in the recess of the pawl and a second end, the elastic element biasing the second end of the peg for exerting a force to the peg toward the pawl, thereby urging the ratchet teeth of the pawl to engage with the teeth of the drive member, wherein the elastic element includes a first end received in the receptacle and a second end outside the receptacle and configured to be attached to the actuating plate, the second end of the peg being received in the elastic element, the first end of the elastic element being configured to bias the second end of the peg toward the recess of the pawl by having the elastic element under tension between the receptacle and the peg; wherein an inner periphery defining the hole of the head includes a first annular groove, and wherein the outer periphery of the drive member includes a second annular groove; and a C-clip received in the first annular groove and the second annular groove, thereby rotatably retaining the drive member in the head.

However, the cavity includes a closed top and a closed bottom, so that only T-shaped blade can be used to make the cavity when manufacturing the head of the wrench. The T-shaped blade is an expensive tool and the size of shank of the T-shaped blade is restricted by the inner periphery of the head so that the shank is easily broken. Furthermore, the hole includes two different diameters which are difficult to be drilled.

The present invention intends to provide a ratchet wrench which is easily manufactured so as to eliminate the shortcomings mentioned above.

SUMMARY OF THE INVENTION

The present invention relates to a ratchet wrench and comprises a body having a through hole defined through the top and the bottom thereof. The through hole has a first recess defined in the inner periphery thereof, and the center of the first recess is located in the through hole. The diameter of the first recess is smaller than the diameter of the through hole. A second recess is defined in the inner periphery of the first recess. The diameter of the second recess is smaller than the diameter of the first recess. Each of the first and second recesses are opened to the top of the body. The second recess has a cone-shaped first positioning portion defined in the inner end thereof. An opening communicates with the lower end of the second recess. A first contact face and a second contact face are defined in the opening. Each of the first and second contact faces is a recessed and curved face. A top recessed area is defined in the top of the body and shares a common axis with the through hole. The top recessed area communicates with the first recess. A first shoulder is formed between the top recessed area and the through hole. A bottom recessed area is defined in the bottom of the body and shares the common axis with the through hole. The inner diameter of the bottom recessed area is the same as the inner diameter of the top recessed area. A second shoulder is formed between the bottom recessed area and the through hole.

A ratchet wheel is rotatably received in the through hole and has a ratchet portion defined in the outer periphery thereof. A connection portion is defined through the ratchet wheel. A first pivotal portion and a second pivotal portion are respectively formed on two ends of the ratchet wheel. The first pivotal portion has a top groove, and the second pivotal portion has a bottom groove. The first pivotal portion is pivotably engaged with the through hole and the top recessed area. The second pivotal portion is pivotably engaged with the through hole and the bottom recessed area.

A pawl is movably received in the first recess and has a toothed face defined in the front side thereof. The toothed face is engaged with the ratchet portion of the ratchet wheel. The pawl has a notch defined in the middle portion of the rear side thereof. The pawl has a contact end defined each of two ends thereof. Either one of the two contact ends selectively contacts the inner periphery of the first recess.

A switch unit is rotatably connected to the second recess to control movement of the pawl in the first recess. The switch unit includes a switch member, a cap and a resilient member. The switch member has a cylindrical member which is pivotably located in the second recess. The cylindrical member has a reception hole which faces the notch. A cone-shaped second positioning portion is formed on the first end of the cylindrical member and received in the first positioning portion. A lever extends radially from the cylindrical member which is pivotably located in the opening. Two sides of the lever are shaped to be matched with the first contact face and the second contact face. A third pivotal portion is formed on the second end of the cylindrical member and has the same diameter as the cylindrical member. The resilient member and the cap are received in the reception hole. The resilient member is biased between the inner end of the reception hole and the cap which is engaged with the notch of the pawl.

A ring is received in the top recessed area and contacts the first shoulder. The ring has a fourth pivotal portion defined in the inner periphery thereof. The fourth pivotal portion is pivotably engaged with the first pivotal portion. The ring has a fifth pivotal portion which is defined in the outer periphery of the ring, and the fifth pivotal portion is pivotably connected to the third pivotal portion.

A top clip is engaged with the top recessed area and the top groove and contacts the ring to restrict the ring from separating from the ratchet wheel. A bottom clip is engaged with the bottom recessed area and the bottom groove and contacts the second shoulder. The ratchet wheel is restricted within the through hole by the ring, the top clip and the bottom clip.

The primary object of the present invention is to provide a ratchet wrench wherein the first and second recesses both have an open top which allows the manufacturers to easily make the through hole, the first recess and the second recess.

The present invention will become more apparent from the following description when taken in connection with the accompanying drawings which show, for purposes of illustration only, a preferred embodiment in accordance with the present invention.

BRIEF DESCRIPTION OF THE DRAWINGS

FIG. 2-1 is a side cross sectional view of the body of the ratchet wrench of the present invention;

DETAILED DESCRIPTION OF THE PREFERRED EMBODIMENT

Figure 1:
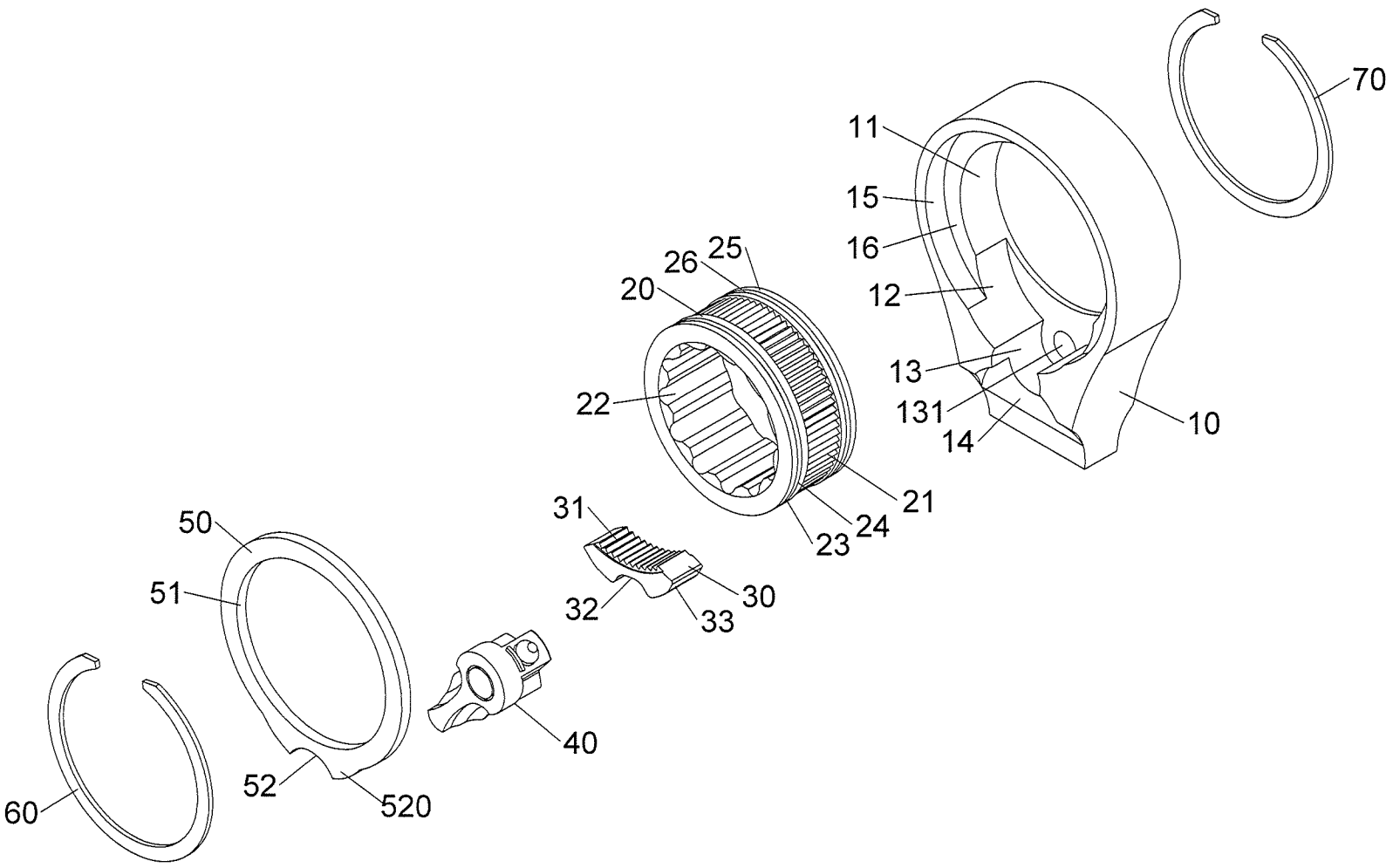
FIG. 1 is an exploded view of the ratchet wrench of the present invention.
Figure 3:
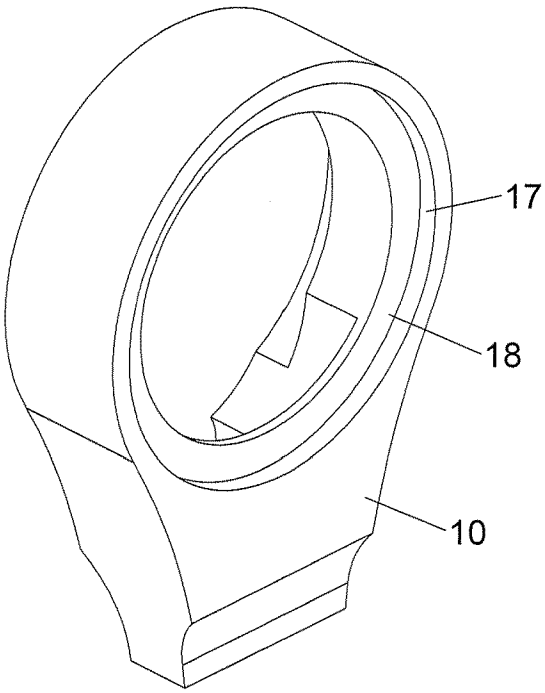
FIG. 3 is a perspective view to show the body of the ratchet wrench of the present invention.
Figures 1, 2:
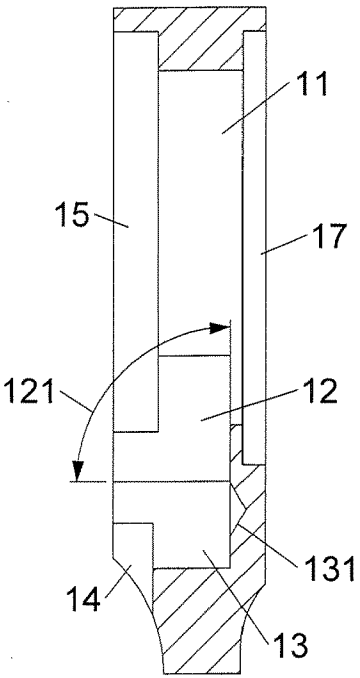
FIG. 2 is a front view of the body of the ratchet wrench of the present invention.
Figure 2:
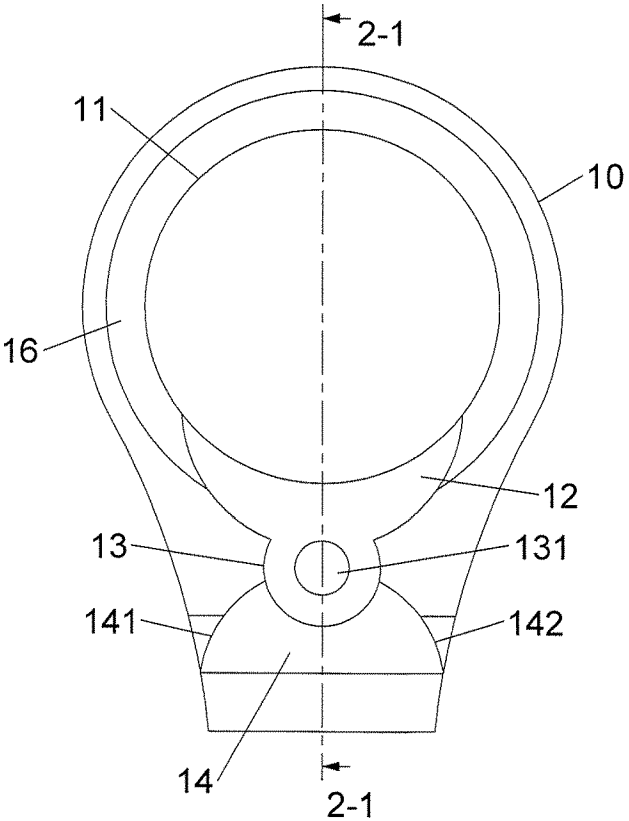
Figure 4:
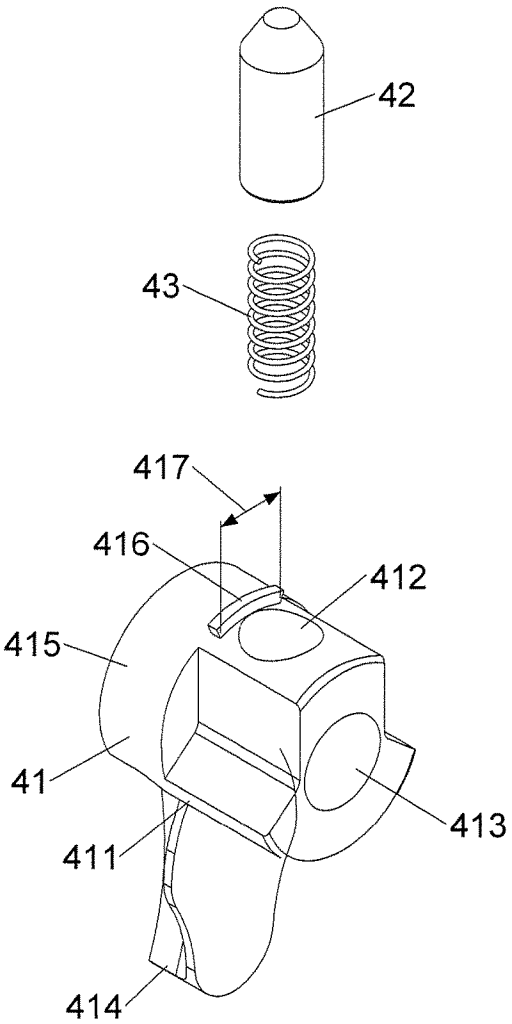
FIG. 4 is an exploded view of the switch unit of the ratchet wrench of the present invention.
Figure 5:
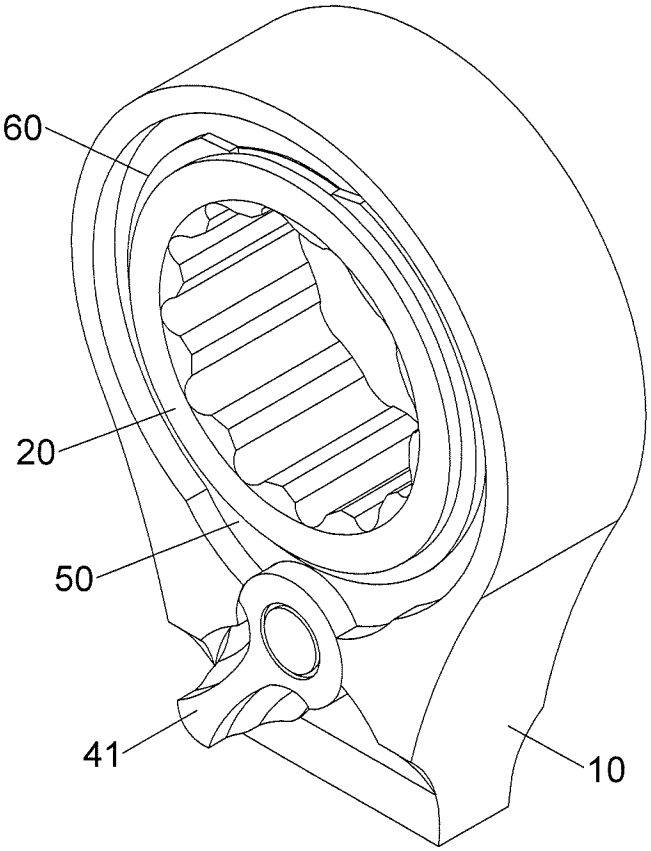
FIG. 5 is a perspective view to show the body of the ratchet wrench of the present invention.

Referring to FIGS. 1 to 3, and 9 to 11, the ratchet wrench of the present invention comprises a body 10 having a through hole 11 defined through the top and the bottom thereof. The through hole 11 has a first recess 12 defined in the inner periphery thereof, and the center of the first recess 12 is located in the through hole 11. The diameter of the first recess 12 is smaller than the diameter of the through hole 11. A first angle 121 is defined between the bottom of the first recess 12 and the inner periphery of the first recess 12. The first angle 121 is between 90 to 120 degrees. Preferably, the first angle 121 is between 90 to 100 degrees. A second recess 13 is defined in the inner periphery of the first recess 12. The top ends of the first and second recesses 12, 13 are opened to the top of the body 10. The diameter of the second recess 13 is smaller than the diameter of the first recess 12. The second recess 13 has a cone-shaped first positioning portion 131 defined on the bottom thereof. An opening 14 communicates with the top portion of the second recess 13. Opposite a first contact face 141 and a second contact face 142 are defined in the opening 14. Each of the first and second contact faces 141, 142 is a recessed and curved face. A top recessed area 15 is defined in the top of the body 10, and recessed from the inner wall of the top portion to the opening of the through hole 11 and shares a common axis with the through hole 11. The top recessed area 15 communicates with the first recess 12. A first shoulder 16 is formed on a bottom of the top recessed area 15, and positioned between the top recessed area 15 and the through hole 11. A bottom recessed area 17 is defined in the bottom of the body 10, and recessed from the inner wall of the bottom portion to the opening of the through hole 11 and shares the common axis with the through hole 11. The inner diameter of the bottom recessed area 17 is the same as the inner diameter of the top recessed area 15. A second shoulder 18 is formed on a bottom of the bottom recessed area 17, and positioned between the bottom recessed area 17 and the through hole 11.

A ratchet wheel 20 is rotatably received in the through hole 11 and has a ratchet portion 21 defined in the outer periphery thereof. A connection portion 22 is defined through the ratchet wheel 20 so as to be connected with an object. A first pivotal portion 23 and a second pivotal portion 25 are respectively formed on two ends of the ratchet wheel 20. The first pivotal portion 23 has a top groove 24, and the second pivotal portion 25 has a bottom groove 26. The first pivotal portion 23 is pivotably engaged with the through hole 11 and the top recessed area 15. The second pivotal portion 25 is pivotably engaged with the through hole 11 and the bottom recessed area 17.

A pawl 30 is movably received in the first recess 12 and has a toothed face 31 defined in the front side thereof. The toothed face 31 is engaged with the ratchet portion 21 of the ratchet wheel 20. The pawl 30 has a notch 32 defined in the middle portion of the rear side thereof. The pawl 30 has a contact end 33 defined each of two ends thereof. Either one of the two contact ends 33 selectively contacts the inner periphery of the first recess 12. A second angle is defined between the contact end 33 and the rear side of the pawl 30 that faces the inner end of the first recess 12. The second angle is matched with the first angle 121.

A switch unit 40 is rotatably connected to the second recess 13 to control movement of the pawl 30 in the first recess 12. The switch unit 40 includes a switch member 41, a cap 42 and a resilient member 43. The switch member 41 has a cylindrical member 411 which is pivotably located in the second recess 13. The cylindrical member 411 has a reception hole 412 which faces the notch 32. A cone-shaped second positioning portion 413 is formed on the first end of the cylindrical member 411 and received in the first positioning portion 131. A lever 414 extends radially from the cylindrical member 411 which is pivotably located in the opening 14. Two sides of the lever 414 are shaped to be matched with the first contact face 141 and the second contact face 142. A third pivotal portion 415 is formed on the second end of the cylindrical member 411 and has the same diameter as the cylindrical member 411. A ridge 416 extends radially from the outer periphery of the switch member 41 and is located beside the reception hole 412. The ridge 416 contacts the inner periphery of the second recess 13. The length 417 of the ridge 416 is longer than the diameter of the reception hole 412. The ridge 416 restricts the maximum angle that the switch member 41 is pivoted within the second recess 13. The resilient member 43 and the cap 42 are received in the reception hole 412. The resilient member 43 is biased between the inner end of the reception hole 412 and the cap 42 which is engaged with the notch 32 of the pawl 30.

A ring 50 is received in the top recessed area 15 and contacts the first shoulder 16. The ring 50 has a fourth pivotal portion 51 defined in the inner periphery thereof. The fourth pivotal portion 51 is pivotably engaged with the first pivotal portion 23. The ring 50 has a fifth pivotal portion 52 which is defined in the outer periphery of the ring 50, and the fifth pivotal portion 52 is pivotably connected to the third pivotal portion 415. The ring 50 is shaped to be matched with the top recessed area 15. The ring 50 presses the ridge 416 to restrict the switch member 41 from disengaging from the second recess 13.

A top clip 60 is engaged with the top recessed area 15 and the top groove 24 and contacts the ring 50 to restrict the ring 50 from separating from the ratchet wheel 20. A bottom clip 70 is engaged with the bottom recessed area 17 and the bottom groove 26 and contacts the second shoulder 18. The ratchet wheel 20 is restricted within the through hole 11 by the ring 50, the top clip 60 and the bottom clip 70.

Figure 7:
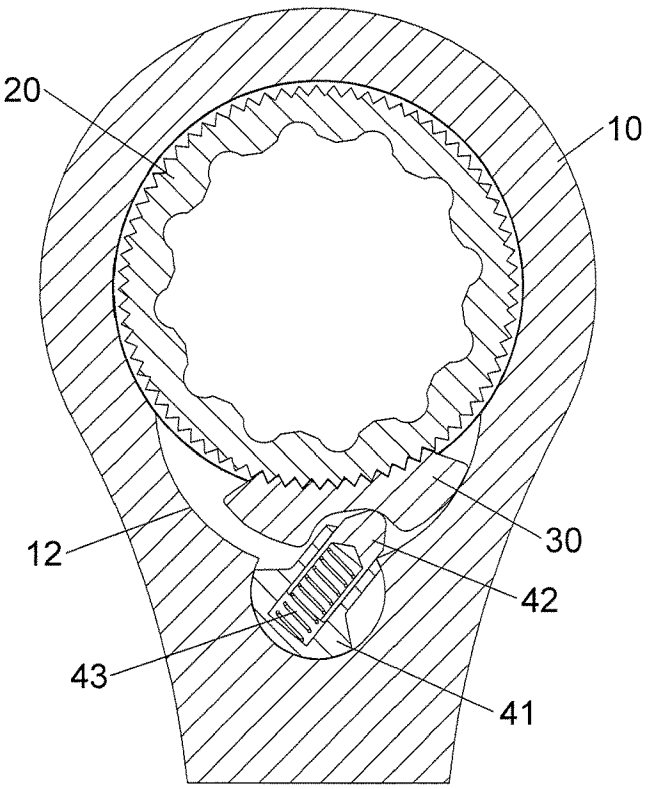
FIG. 7 is a cross sectional view, taken along A-A in FIG. 6.
Figure 6:
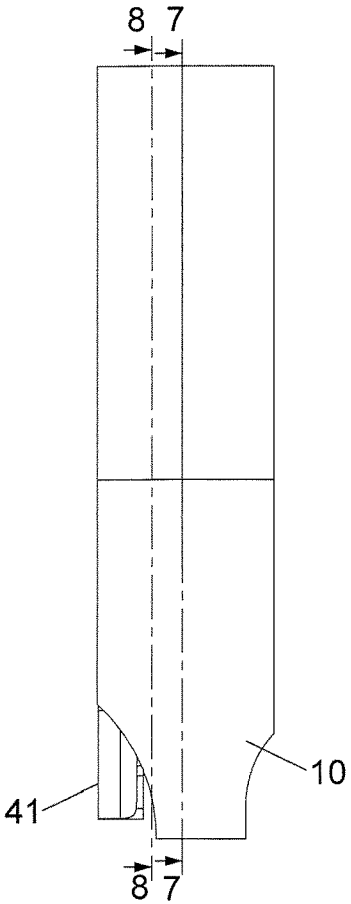
FIG. 6 is a side view of the body of the ratchet wrench of the present invention.

As shown in FIGS. 6 and 7, the toothed face 31 is engaged with the ratchet portion 21. The switch unit 40 is pivotably received in the second recess 13. The cap 42 is biased by the resilient member 43 and engaged with the notch 32 of the pawl 30. When the users pivots the lever 414, the switch unit 40 is pivoted to control the movement of the pawl 30 so as to control the torque output from the ratchet wrench.

Figure 8:
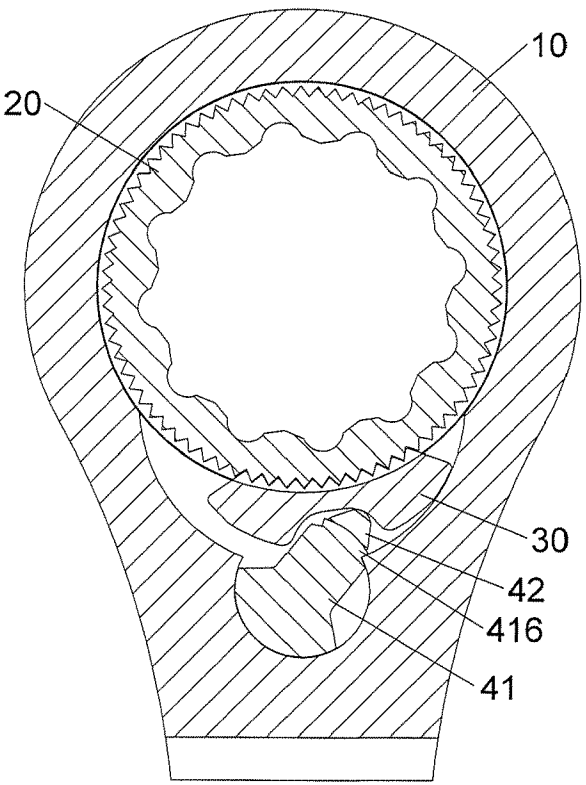
FIG. 8 is a cross sectional view, taken along B-B in FIG. 6.
Figure 11:
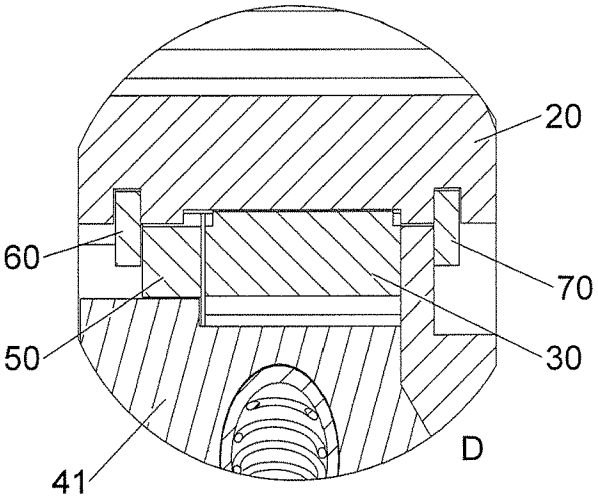
FIG. 11 is an enlarged view of the circled D in FIG. 10.
Figure 10:
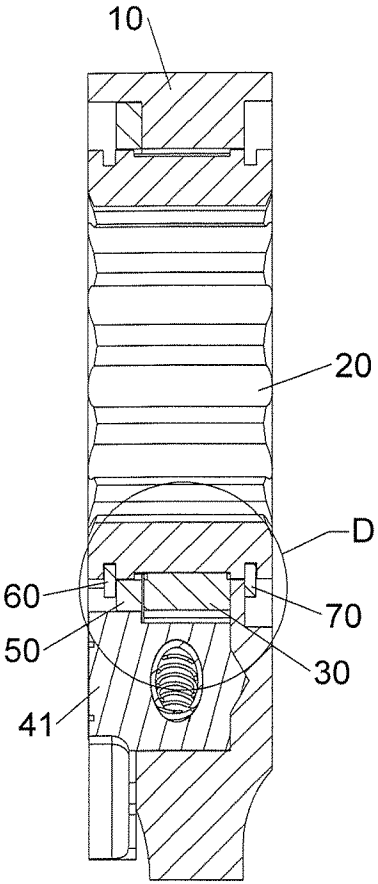
FIG. 10 is a cross sectional view, taken along C-C in FIG. 9.
Figure 9:
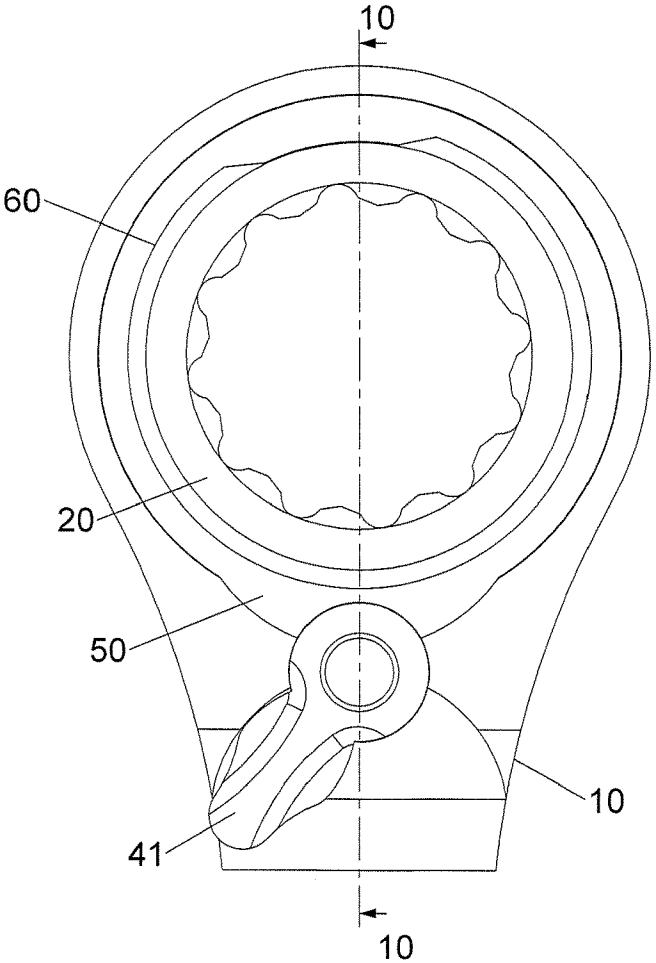
FIG. 9 is a front view of the ratchet wrench of the present invention.

As shown in FIG. 8, because the length 417 of the ridge 416 is longer than the diameter of the reception hole 412, when the switch unit 40 is pivoted to control the movement of the pawl 30 in the first recess 12, the ridge 416 contacts one end of the second recess 13 to restricts the maximum angle that the switch member 41 is pivoted within the second recess 13.

Figure 12:
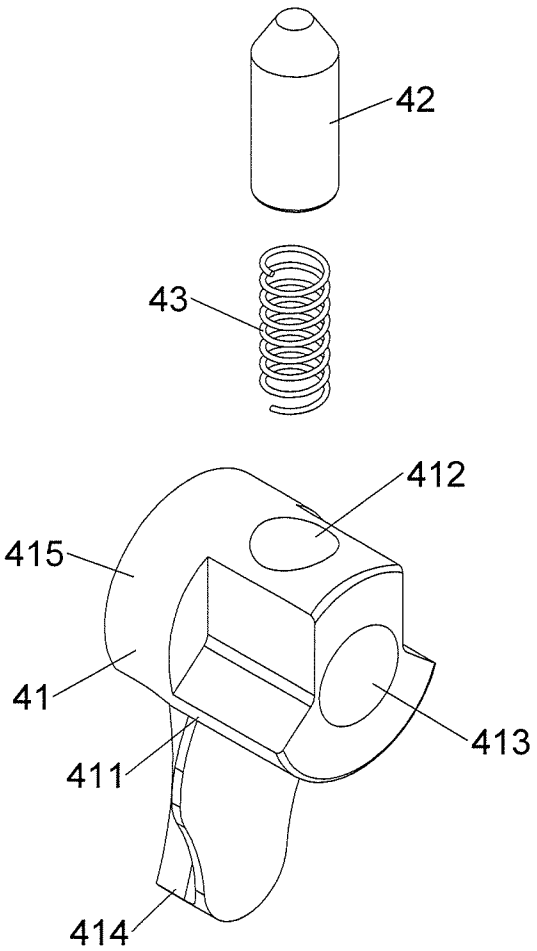
FIG. 12 is an exploded view of the switch unit of the second embodiment of the ratchet wrench of the present invention.

As shown in FIG. 12 which shows the second embodiment, wherein the switch member 41 does not have the ridge 416, and the cap 50 contacts the cap 42 to pivotably connect the switch unit 40 to the second recess 13.

The first and second recesses 12, 13 both have an open top so that the tool is easily operated to make the first and second recesses 12, 13. The through hole 11. The through hole 11 is defined through the top and the bottom of the body 10 so that the tool does not need to control the cutting depth when drilling the through hole 11. The through hole 11, the first recess 12 and the second recess 13 can be made by the same tool so that accumulated tolerance can be avoided. The through hole 11, the first recess 12 and the second recess 13 all have the same open top so that the body 10 can be made by way of pressing within one time of press. The body 10 can be made by different methods according to practical need. As shown in FIG. 8, because the length 417 of the ridge 416 is longer than the diameter of the reception hole 412, when the switch unit 40 is pivoted to control the movement of the pawl 30 in the first recess 12, the ridge 416 contacts one end of the second recess 13 to restricts the maximum angle that the switch member 41 is pivoted within the second recess 13. This also prevents the cap 42 from hitting the end of the second recess 13. The maximum angle of the movement of the switch member 41 is restricted by the two sides of the lever 414 contacting the first contact face 141 and the second contact face 142. The switch member 41 is pivotably received in the semi-circular second recess 13, and the third pivotal portion 415 is pivotably connected to the fourth pivotal portion 52, so that the switch member 41 is stably positioned. The second positioning portion 413 is received in the first positioning portion 131, so that the switch member 41 is pivotably connected to the center of the second recess 13. The top and bottom clips 60, 70 make the assemblers to conveniently assemble the ratchet wrench. The top clip 60 position the ring 50 to the top groove 24 to allow the ratchet wheel 20, the pawl 30 and the resilient member 43 to be received in the body 10. The bottom clip 70 is used to pivotably position the ratchet wheel 20.

The first pivotal portion 23 is pivotably connected to the third pivotal portion 51, and the second pivotal portion 25 is pivotably received in the through hole 11, so that the ratchet wheel 20 is stably located. The ratchet wheel 20 is easily removed from the through hole 11 by removing the top clip 60 or the bottom clip 70.

While we have shown and described the embodiment in accordance with the present invention, it should be clear to those skilled in the art that further embodiments may be made without departing from the scope of the present invention.

What is claimed is:

1. A ratchet wrench comprising:

a body having a through hole defined through a top and a bottom thereof, the through hole having a first recess defined in an inner periphery thereof, a center of the first recess located in the through hole, a diameter of the first recess being smaller than a diameter of the through hole, a second recess defined in an inner periphery of the first recess, a diameter of the second recess being smaller than the diameter of the first recess, wherein each of the first and second recesses being opened to the top of the body, the second recess having a first positioning portion being a cone-shaped protrusion and defined on a bottom thereof, an opening communicating with a top portion of the second recess, a first contact face and a second contact face defined in the opening; wherein a top recessed area defined in the top of the body, and recessed from a top portion to a top opening of the through hole and sharing a common axis with the through hole; the top recessed area communicating with the first recess; a first shoulder formed on a bottom of the top recessed area, and positioned between the top recessed area and the through hole; a bottom recessed area defined in the bottom of the body, and recessed from a bottom portion to a bottom opening of the through hole and sharing the common axis with the through hole; a second shoulder formed on a bottom of the bottom recessed area, and positioned between the bottom recessed area and the through hole;

a ratchet wheel rotatably received in the through hole and having a ratchet portion defined in an outer periphery thereof, a connection portion defined through the ratchet wheel, a first pivotal portion and a second pivotal portion respectively formed on two ends of the ratchet wheel, the first pivotal portion having a top groove, the second pivotal portion having a bottom groove, the first pivotal portion pivotably engaged with the through hole and the top recessed area, the second pivotal portion pivotably engaged with the through hole and the bottom recessed area;

a pawl movably received in the first recess and having a toothed face defined in a front side thereof, the toothed face engaged with the ratchet portion of the ratchet wheel, the pawl having a notch defined in a middle portion of a rear side thereof, the pawl having a contact end defined at each of two ends thereof, either one of the two contact ends selectively contacting the inner periphery of the first recess;

a switch unit rotatably connected to the second recess to control movement of the pawl in the first recess, the switch unit including a switch member, a cap and a resilient member, the switch member having a cylindrical member which is pivotably located in the second recess, the cylindrical member having a reception hole which faces the notch; a second positioning portion being a cone-shaped recess and formed on a first end of the cylindrical member, and received in the first positioning portion; a lever extending radially from the cylindrical member which is pivotably located in the opening, two sides of the lever being shaped to be matched with the first contact face and the second contact face, a third pivotal portion formed on a second end of the cylindrical member and having a same diameter as the cylindrical member;

the resilient member and the cap received in the reception hole, the resilient member biased between an inner end of the reception hole and the cap which is engaged with the notch of the pawl;

a ring received in the top recessed area and contacting the first shoulder, the ring having a fourth pivotal portion defined in an inner periphery thereof, the fourth pivotal portion being pivotably engaged with the first pivotal portion, the ring having a fifth pivotal portion which is defined in an outer periphery of the ring, the fifth pivotal portion being pivotably connected to the third pivotal portion;

a top clip engaged with the top recessed area and the top groove and contacting the ring to restrict the ring from separating from the ratchet wheel, and a bottom clip engaged with the bottom recessed area and the bottom groove and contacting the second shoulder, the ratchet wheel being restricted within the through hole by the ring, the top clip and the bottom clip.

2. The ratchet wrench as claimed in claim 1, wherein a first angle is defined between an inner end of the first recess and the inner periphery of the first recess, the first angle is from 90 to 120 degrees, a second angle is defined between the contact end and a rear side of the pawl that faces the inner end of the first recess, the second angle is matched with the first angle.

3. The ratchet wrench as claimed in claim 2, wherein the first angle is from 90 to 100 degrees.

4. The ratchet wrench as claimed in claim 1, wherein the connection portion is a polygonal hole or a rectangular protrusion.

5. The ratchet wrench as claimed in claim 1, wherein a ridge extends radially from an outer periphery of the switch member and is located beside the reception hole, the ridge contacts an inner periphery of the second recess, a length of the ridge is longer than a diameter of the reception hole, the ridge restricts a maximum angle that the switch member is pivoted within the second recess, the ring presses the ridge to restrict the switch member from disengaging from the second recess.

6. The ratchet wrench as claimed in claim 1, wherein the top clip and the bottom clip each are a resilient C-clip.

7. The ratchet wrench as claimed in claim 1, wherein the ring contacts the cap to locate the switch unit 40 in the second recess.

8. The ratchet wrench as claimed in claim 1, wherein each of the first and second contact faces being a recessed and curved face.

9. The ratchet wrench as claimed in claim 1, wherein an inner diameter of the bottom recessed area being the same as an inner diameter of the top recessed area.

* * * * *